US009316411B2

(12) United States Patent
Sherrow et al.

(10) Patent No.: US 9,316,411 B2
(45) Date of Patent: Apr. 19, 2016

(54) HVAC FURNACE

(75) Inventors: Lester D. Sherrow, Mukwonago, WI (US); Nancy Souvoravong, Daniel Island, SC (US); Jeffery Wayne O'Daniel, Quitman, TX (US)

(73) Assignee: Trane International Inc., Piscataway, NJ (US)

( * ) Notice: Subject to any disclaimer, the term of this patent is extended or adjusted under 35 U.S.C. 154(b) by 489 days.

(21) Appl. No.: 13/554,482

(22) Filed: Jul. 20, 2012

(65) Prior Publication Data

US 2014/0020669 A1 Jan. 23, 2014

(51) Int. Cl.

| | |
|---|---|
| ***F24H 9/00*** | (2006.01) |
| ***F24H 3/08*** | (2006.01) |
| ***F24H 9/18*** | (2006.01) |

(52) U.S. Cl.

CPC ..... *F24H 9/0068* (2013.01); *F24H 3/087* (2013.01); *F24H 9/1881* (2013.01)

(58) Field of Classification Search

CPC ..... F23H 3/06; F23H 3/08; F23H 3/087; F23H 3/10; F23H 3/105; F24H 9/0068; F24H 3/087; F24H 9/1881; F24H 3/06; F24H 3/08; F24H 3/10; F24H 3/105; F23D 14/02; F23D 14/62

USPC ..... 126/110 A, 110 B, 110 C

See application file for complete search history.

(56) References Cited

U.S. PATENT DOCUMENTS

| | | | | |
|---|---|---|---|---|
| 1,732,071 | A | 10/1929 | Shaw | |
| 3,405,921 | A | 10/1968 | Rohrs | |
| 3,419,338 | A | 12/1968 | Dirk et al. | |
| 5,458,484 | A | 10/1995 | Ripka | |
| 5,545,031 | A | 8/1996 | Joshi et al. | |
| 5,996,352 | A * | 12/1999 | Coughlan et al. | 60/748 |
| RE36,743 | E | 6/2000 | Ripka | |
| 6,889,686 | B2 | 5/2005 | Specht | |
| 2008/0314378 | A1 * | 12/2008 | Khan et al. | 126/99 R |
| 2013/0213378 | A1 * | 8/2013 | Schultz | 126/110 C |
| 2013/0213379 | A1 * | 8/2013 | Schultz et al. | 126/110 C |

* cited by examiner

*Primary Examiner* — Alfred Basichas

(74) *Attorney, Agent, or Firm* — Conley Rose, P.C.; J. Robert Brown, Jr.; Michael J. Schofield

(57) ABSTRACT

A heating, ventilation, and/or air conditioning (HVAC) furnace has a flat burner comprising an upstream side and a downstream side, the flat burner being configured to receive an air-fuel mixture therethrough, a first flow path located adjacent the flat burner and downstream relative to the flat burner, the first flow path configured to receive fluid exiting the flat burner, and a plurality of second flow paths located downstream relative to the first flow path, the plurality of second flow paths being configured to receive fluid from the first flow path.

18 Claims, 5 Drawing Sheets

HVAC FURNACE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) furnaces are widely used in commercial and residential environments for heating and otherwise conditioning interior spaces. Gas-fired furnaces are known to generate and emit oxides of nitrogen (NOX). NOX is a term used herein to describe the various oxides of nitrogen, in particular NO, N2O and NO2. NOX emissions from gas-fired furnaces are typically attributable to less than optimal air-fuel mixtures and combustion temperatures.

SUMMARY

In some embodiments, a heating, ventilation, and/or air conditioning (HVAC) furnace is provided. The HVAC furnace may comprise a flat burner comprising an upstream side and a downstream side, the flat burner being configured to receive an air-fuel mixture therethrough, a first flow path located adjacent the flat burner and downstream relative to the flat burner, the first flow path configured to receive fluid exiting the flat burner, and a plurality of second flow paths located downstream relative to the first flow path, the plurality of second flow paths being configured to receive fluid from the first flow path.

In other embodiments, a method of operating a furnace is provided. The method may comprise providing a flat burner comprising an upstream side and a downstream side, mixing air and fuel upstream of the flat burner to provide an air-fuel mixture to the upstream side of the flat burner, and pulling the air-fuel mixture through the flat burner.

In yet other embodiments, a furnace may be provided that may comprise a mixture distributing box, a post-combustion chamber coupled to the mixture distributing box, wherein the coupling of the mixture distributing box and the post-combustion chamber substantially envelope a cavity, a flat burner disposed within the cavity, an upstream heat exchanger comprising a plurality of parallel heat exchanger flow paths configured to receive fluid from the cavity, and an inducer blower in fluid communication with the upstream heat exchanger, the inducer blower being configured to pull fluid through the flat burner and the upstream heat exchanger.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Lowering $NO_X$ emissions attributable to a furnace may be accomplished by lowering the burn temperature of an air-fuel mixture in the burners of a gas-fired furnace. It may be desirable to lower the $NO_X$ production to below 14 nano-grams per joule (ng/J) of energy used. It may also be desirable to lower the $NO_X$ production to below 14 ng/J in an economical and space efficient manner. Accordingly, a furnace with a so-called flat burner for efficiently lowering the burn temperature of an air-fuel mixture is provided. The furnace may comprise one or more flat burners substantially similar to the flat burners sold by Worgas of Formigine, Italy, although other flat burners may be used. The flat burner may be inserted between a mixing box and a post-combustion chamber of a furnace so an air-fuel mixture is provided to a first side of the flat burner. Because mixing of the air and the fuel primarily occurs upstream relative to the flat burner, the flat burner may be referred to as a premix flat burner. A second side of the flat burner may face a heat exchanger configured to receive fluid that flows from the flat burner.

Figure 1:
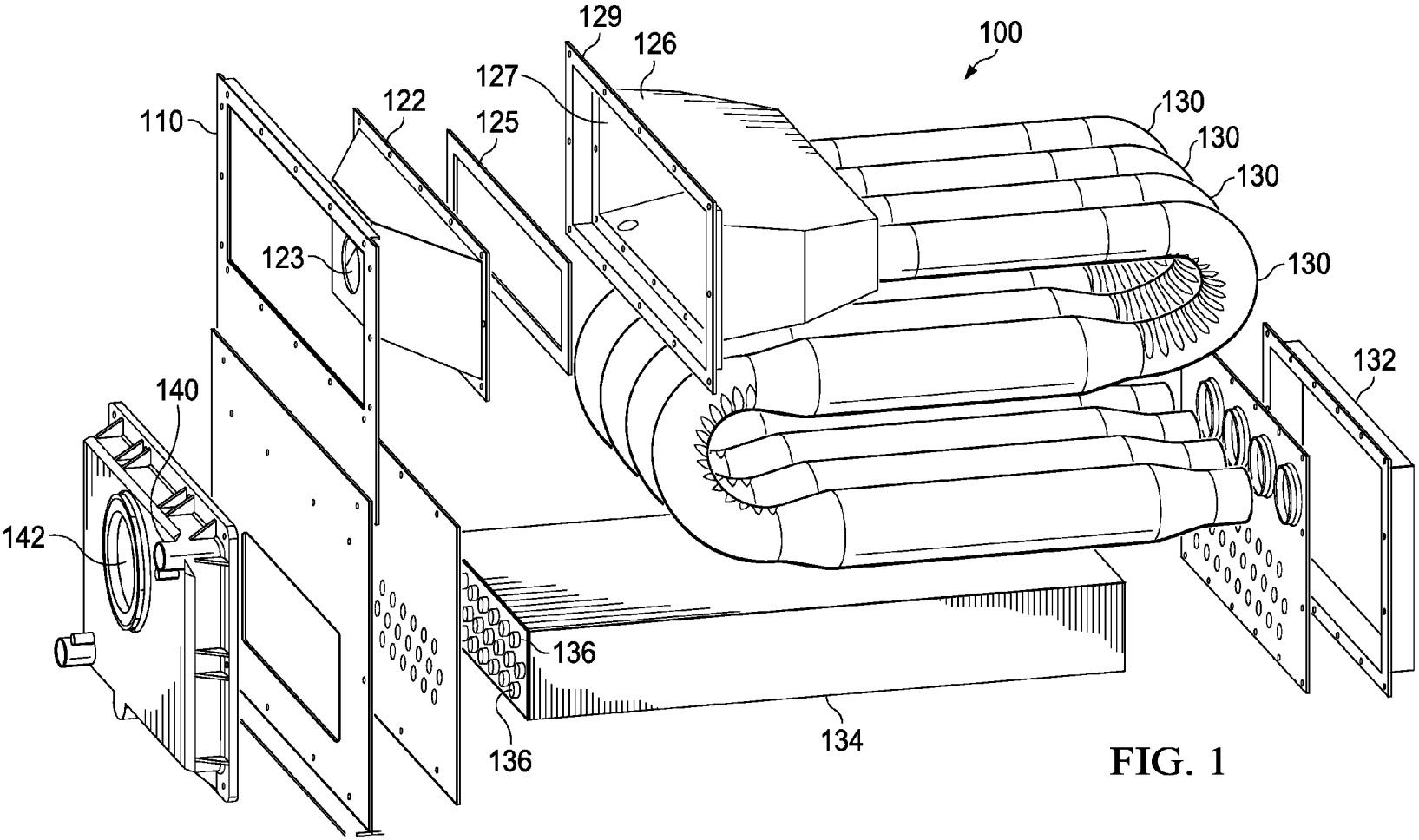
FIG. 1 is an oblique exploded view of a furnace according to an embodiment of the disclosure.
Figure 2:
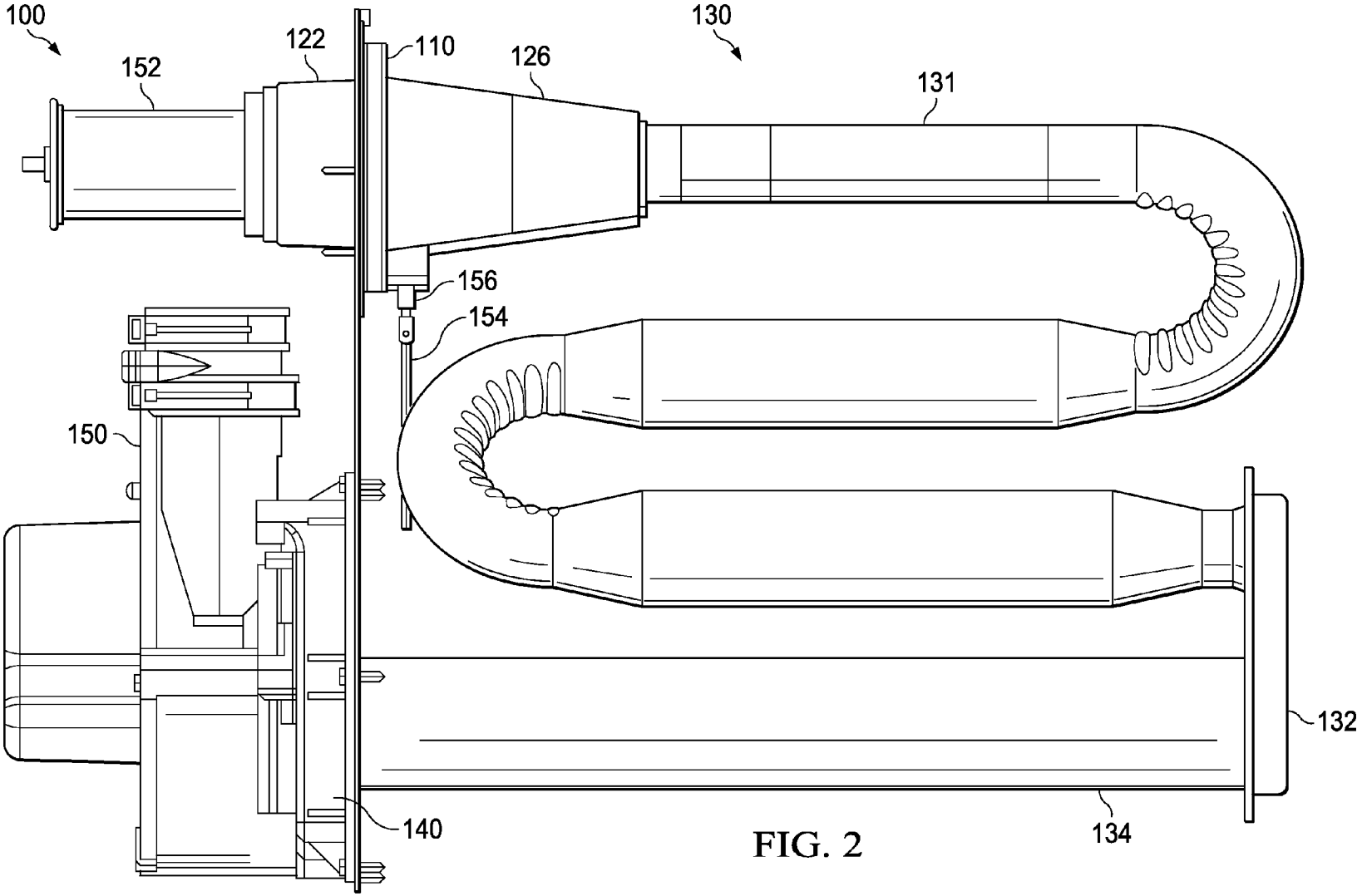
FIG. 2 is an orthogonal side view of the furnace of FIG. 1.

Referring to FIGS. 1 and 2, an oblique exploded view and an orthogonal side view of a furnace 100 are shown, respectively. The furnace 100 may comprise a partition panel 110, a mixture distributing box 122, a flat burner 125, a post-combustion chamber 126, at least one first or upstream heat exchanger 130, a manifold 132, a second or downstream heat exchanger 134, and a heat exchanger exhaust chamber 140.

The mixture distributing box 122 may be mounted to the partition panel 110 so that an inlet 123 of distributing box 122 may direct an air-fuel mixture toward flat burner 125. The mixture distributing box 122 may promote even distribution of the air-fuel mixture across a cross-sectional area of an air-fuel mixture flow path and/or may promote even distribution of the air-fuel mixture across an upstream side of the flat burner 125, as will be discussed further herein. The flat burner 125 may be thin and/or compact and may occupy little space within the furnace 100, especially in the upstream/downstream directions of primary air-fuel mixture flow, thereby providing a space efficient furnace 100. The mixing of the air and fuel prior to entering the distributing box 122 may be aided by a mixing device such as a premixer 152 (see FIG. 2) to promote homogenous mixing of the air and fuel prior to entering the mixture distributing box 122. Alternatively, fuel may be introduced directly into the mixture distributing box 122 by a gas supply valve. The gas supply valve may be controlled electrically, pneumatically, or in any other suitable manner to obtain a beneficial air to fuel ratio for increased efficiency and lower $NO_X$ emissions. The gas supply valve may be configured for either staged operation or modulation type operation. For example, staged operation may have two flow rate and/or capacity settings, where modulation type operation may be incrementally adjustable over a large range of flow rates, for example from 40% to 100% output capacity of the furnace 100.

In some embodiments, the flat burner 125 may extend across substantially an entire cross-sectional area of the air-fuel mixture flow path. The air-fuel mixture may flow from the mixture distributing box 122 through the flat burner 125 and into the post-combustion chamber 126. The flat burner 125 may be permeable, such as to allow the air-fuel mixture to travel through the flat burner 125 without a substantial pressure drop across the flat burner 125. For example, the flat burner 125 may comprise a great number of small perforations over a substantial portion of the upstream and downstream sides of the flat burner 125. Alternatively, a substantial portion of the upstream and downstream sides of the flat burner 125 may comprise one or more layers of woven material configured to allow the air-fuel mixture to flow therethrough. Still further, in other alternative embodiments, the flat burner 125 may comprise a combination of both perforations and woven material.

The flat burner 125 may be received within a cavity formed by the coupling of the mixture distributing box 122 and the post-combustion chamber 126. In some embodiments, a flange 129 of the flat burner 125 may be sandwiched between the mixture distributing box 122 and the post-combustion chamber 126 so that substantially all of the air-fuel mixture may pass through the flat burner 125 prior to exiting the above-described cavity. When the flat burner 125 is received within the above-described cavity the upstream side of the flat burner 125 may face the mixture distributing box 122 and an opposing downstream side of the flat burner 125 may face the post-combustion chamber 126. Post-combustion chamber 126 may be configured to output the combusted air-fuel mixture into multiple parallel flow paths, as will be discussed further herein.

The one or more upstream heat exchangers 130 may be configured to receive an at least partially combusted air-fuel mixture downstream of the flat burner 125 and each upstream heat exchanger 130 may form a separate flow path downstream relative to the flat burner 125. The downstream heat exchanger 134 may be configured to receive the at least partially combusted air-fuel mixture from the upstream heat exchangers 130. Heat exchanger 134 may comprise a fin-tube type heat exchanger and/or plate-fin type heat exchanger, either of which may comprise one or more tubes 136. In other embodiments, the heat exchanger may comprise a so-called clamshell heat exchanger.

In some embodiments, the at least partially combusted air-fuel mixture may be transferred from the one or more upstream heat exchangers 130 to downstream heat exchanger 134 through the manifold 132. While furnace 100 is described above as comprising one flat burner 125, alternative furnace embodiments may comprise more than one flat burner 125. In some cases, additional flat burners 125 may be utilized to increase an overall heating capacity. In some embodiments, several flat burners 125 may be aligned in parallel, so that multiple parallel air-fuel mixture flow paths may be formed. Further, while furnace 100 is disclosed as comprising at least one upstream heat exchanger 130 and a downstream heat exchanger 134, alternative furnace embodiments may comprise only one upstream heat exchanger no downstream heat exchanger 134, and/or multiple downstream heat exchangers 134.

An igniter 154 (see FIG. 2) may be mounted partially within the post-combustion chamber 126 proximal to the downstream side of the flat burner 125 to ignite the air-fuel mixture a short distance downstream from the downstream side of the flat burner 125. The air-fuel mixture may be moved in an induced draft manner by pulling the air-fuel mixture through the furnace 100 and/or in a forced draft manner by pushing the air-fuel mixture through the furnace 100. The induced draft may be produced by attaching a blower and/or fan downstream, such as inducer blower 150 (see FIG. 2) relative to the heat exchanger exhaust chamber 140 and pulling the air-fuel mixture out of the system by creating a lower pressure at the exhaust of the heat exchanger exhaust chamber 140 as compared to the pressure upstream of the flat burner 125. Inducing flow in the above-described manner may protect against leaking the at least partially combusted air-fuel mixture and related products of combustion to the surrounding environment by ensuring the at least partially combusted air-fuel mixture is maintained at a pressure lower than the air pressure surrounding the furnace 100. With such an induced flow, any leak along the flow path of the air-fuel mixture may result in pulling environmental air into the flow path rather than expelling the at least partially combusted air-fuel mixture and related products of combustion to the environment. In alternative embodiments, the air-fuel mixture may be forced along the air-fuel mixture flow path by placing a blower or fan upstream relative to the flat burner 125 and creating higher pressure upstream of the flat burner 125 relative to a lower pressure at the exhaust of the heat exchanger exhaust chamber 140. In some embodiments, a control system may control the inducer blower 150 to an appropriate speed to achieve desired fluid flow rates for a desired firing rate through the flat burner 125. Increasing the speed of the inducer blower 150 may introduce more air to the air-fuel mixture, thereby changing the characteristics of the combustion achieved by the flat burner 125. In some embodiments, a so-called zero governor regulator and/or zero governor gas valve may be additionally utilized to provide a desired fuel to air ratio in spite of the varying effects of an induced draft and/or other pressure variations that may fluctuate and/or otherwise tend to cause dispensing or more or less fuel in response to the pressure variations and/or negative pressures relative to atmospheric pressure.

Substantially enclosing the flat burner 125 within a cavity formed by the connecting of the mixture distributing box 122 and the post-combustion chamber 126 and substantially combusting the air-fuel mixture near the flat burner 125 may reduce the surface temperatures of the post-combustion chamber 126 and upstream heat exchangers 130 as compared to embodiments utilizing other types of burners. While the downstream side of the flat burner 125 is disclosed as facing the post-combustion chamber 126 while the upstream side of the flat burner 125 faces the mixture distributing box 122, in alternative embodiments, the flat burner 125 may be positioned differently and/or the flow of the air-fuel mixture may be passed through the flat burner 125 in a different manner. The post-combustion chamber 126 is connected to the upstream heat exchangers 130 so that the at least partially combusted air-fuel mixture enters directly into the upstream heat exchangers 130, as will be discussed further herein. The post-combustion chamber 126 may seal the air-fuel mixture flow path from secondary dilution air as well as position the flat burner 125 in a manner conducive for transferring the at least partially combusted air-fuel mixture to the upstream heat exchangers 130. While the upstream heat exchangers 130 are disclosed as comprising a plurality of tubes, in alternative embodiments, the upstream heat exchangers may comprise clamshell heat exchangers, drum heat exchangers, shell and tube type heat exchangers, and/or any other suitable type of heat exchanger.

Referring now to FIG. 2, the furnace 100 is shown as comprising the inducer blower 150, the air-fuel premixer 152, the igniter 154, and the flame sensor 156. Premixer 152 may comprise a Venturi style air-fuel mixer or any other suitable style of air-fuel mixers. The igniter 154 may comprise a pilot light, a spark igniter, a piezoelectric device, and/or a hot surface igniter. The igniter 154 may be controlled by a control system and/or may be manually ignited. The flame sensor 156 may comprise a thermocouple, a flame rectification device, and/or any other suitable safety device.

Figure 3:
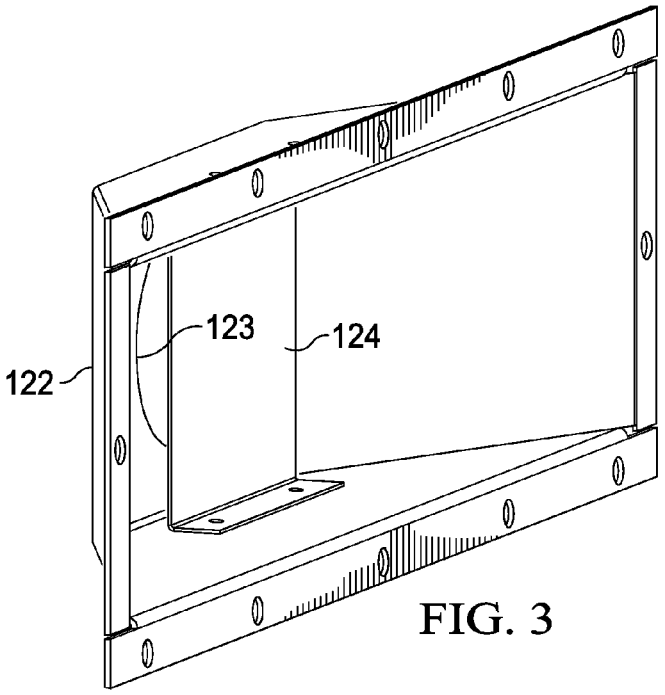
FIG. 3 is an oblique view of a mixture distributing box of the furnace of FIG. 1.

Referring now to FIG. 3, an oblique view of mixture distributing box 122 is shown. The mixture distributing box 122 may comprise an inlet 123 and a deflector 124. Deflector 124 may be connected to and received within mixture distributing box 122. The shape and positioning of deflector 124 within mixture distributing box 122 with respect to inlet 123 may be configured to promote even distribution of the air-fuel mixture entering mixture distributing box 122 over a cross-sectional area of the flow path of the air-fuel mixture and/or to promote even distribution of the air-fuel mixture over an upstream side of the flat burner 125 disposed downstream of the deflector 124. The above-described increased even distributions of the air-fuel mixture may promote a more homogenous temperature distribution within the post-combustion chamber 126 and/or the upstream heat exchangers 130. While deflector 124 is shown as comprising a rectangular plate with an upstream side facing inlet 123, in alternative embodiments, a deflector may comprise any another shape and/or device configured to disturb fluid flow entering mixture distributing box 122.

Figure 4:
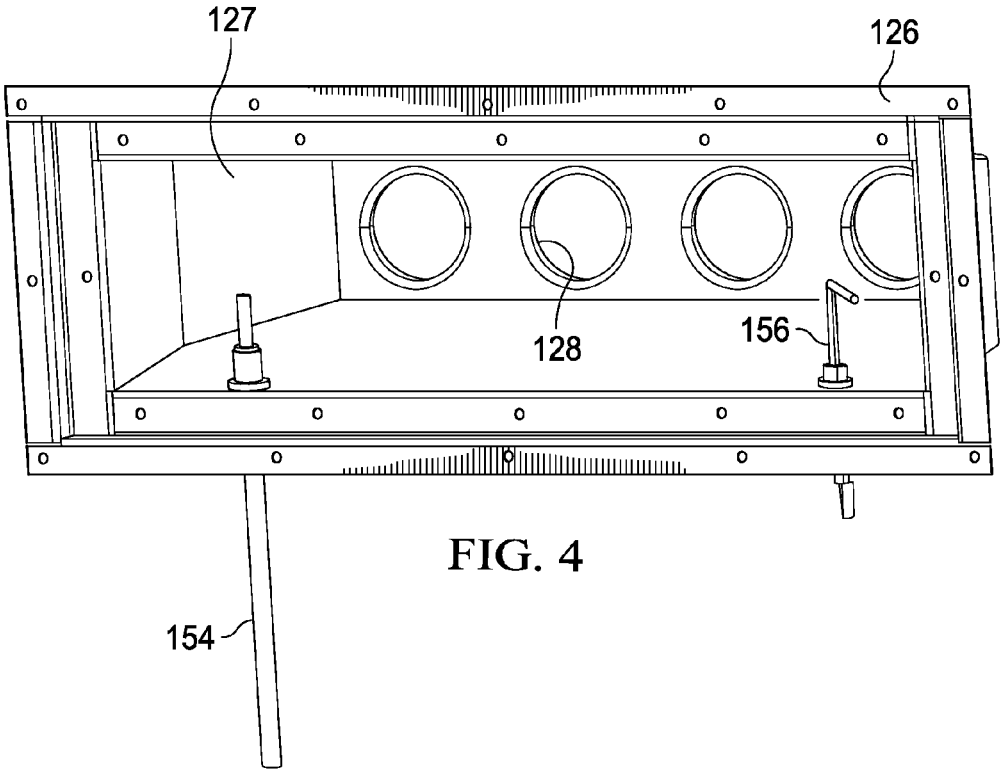
FIG. 4 is an oblique view of a post-combustion chamber of the furnace of FIG. 1.

Referring now to FIG. 4, an oblique view of post-combustion chamber 126 is shown. In this embodiment, igniter 154 and flame sensor 156 are disposed within an inlet 127 of post-combustion chamber 126. Post-combustion chamber 126 may further comprise a plurality of outlets 128 that may be configured to directly couple to the upstream heat exchangers 130. Flat burner 125 may be disposed upstream of post-combustion chamber 126, an inputted air-fuel mixture may be ignited by igniter 154, and the at least partially combusted air-fuel mixture may pass through a substantially undivided space of the post-combustion chamber 126 prior to passing into a plurality of separate flow paths via outlets 128.

Figure 5:
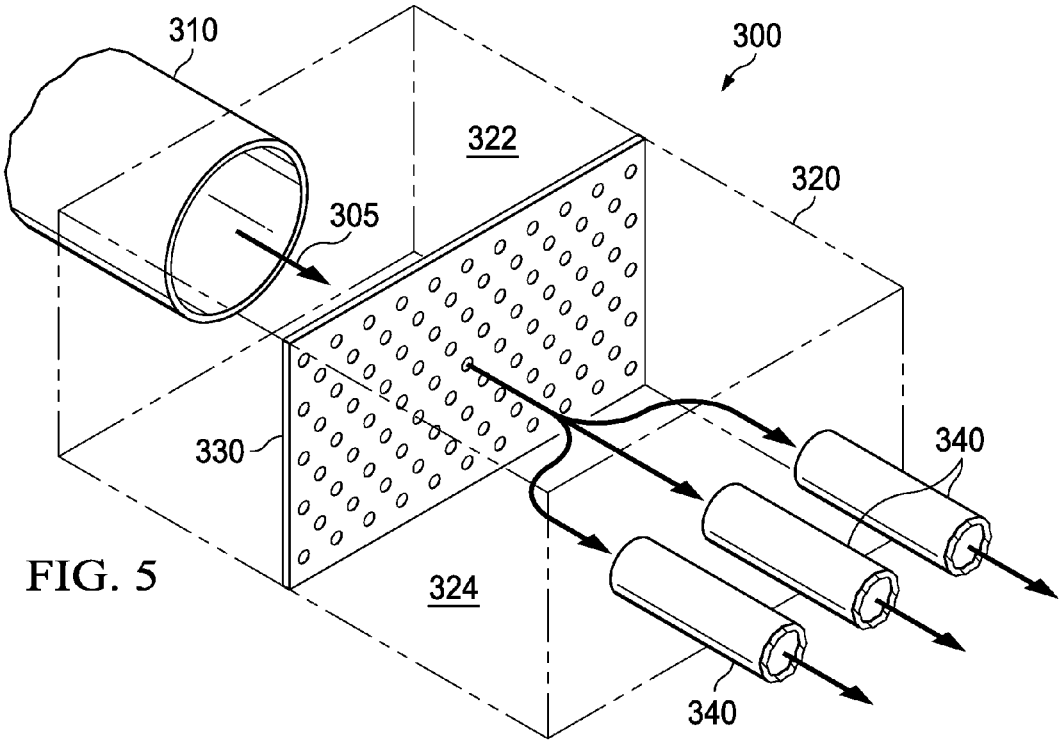
FIG. 5 is a schematic view of a flat burner combustion system according to an embodiment of the disclosure.

Referring to FIG. 5, a schematic view of an embodiment of a flat burner combustion system 300 is shown. In this embodiment, system 300 may comprise a fluid flow path 305 that extends from an air-fuel premixer 310 through a chamber 320 and into one or more heat exchanger tubes 340. Chamber 320 may comprise a flat burner 330 that extends over substantially an entire cross-sectional area of the chamber 320. Flat burner 330 may generally denote a fluid-permeable boundary between an upstream chamber volume 322 and a downstream chamber volume 324. As an air-fuel mixture flows along flow path 305, the air-fuel mixture may exit premixer 310 and enter upstream chamber volume 322 before contacting flat burner 330. As shown in FIG. 5, the entirety of flow path 305 may extend through flat burner 330 before entering downstream chamber volume 324. Thus, substantially all fluid flowing along flow path 305 may flow through flat burner 330 to enter downstream chamber volume 324. As the fluid flowing along flow path 305 flows through flat burner 330 and enters downstream chamber volume 324, it may be ignited by an ignition source to cause at least partial combustion of and/or rapid heating of the fluid. The fluid within downstream chamber volume 324 may thereafter enter one or more heat exchanger tubes 340. Heat exchanger tubes 340 may each comprise an exterior surface in contact with a second fluid flow configured to receive heat from the fluid flowing along flow path 305.

Figure 6:
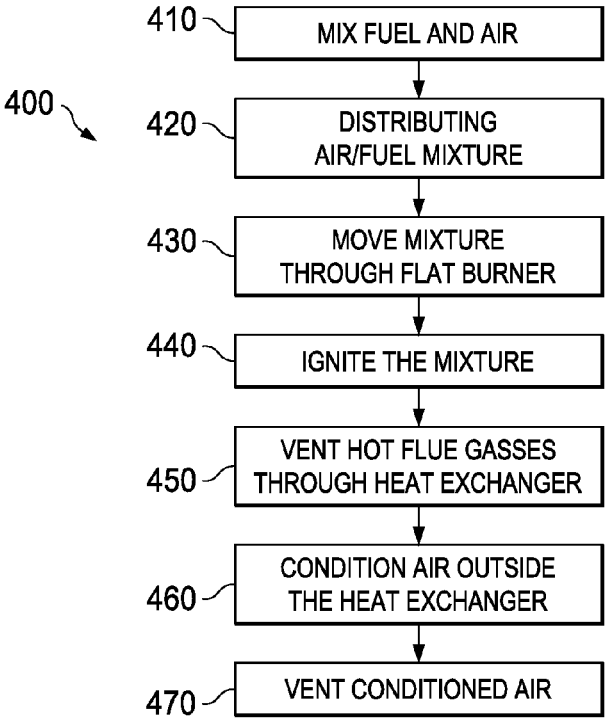
FIG. 6 is a flowchart of a method of operating a furnace according to an embodiment of the disclosure.

Referring now to FIG. 6, a block diagram depicting a method 400 of operating a furnace is shown. The method may begin at block 410 by mixing a fuel and air together. An air-fuel mixer and/or so-called premixer may be utilized to accomplish the mixing of the fuel in the air. The fuel may comprise natural gas available from a gas valve attached to a mixture distributing box or to an air-fuel premixer upstream of the mixture distributing box. Alternatively, the fuel may comprise propane and/or any other suitable fuel. The air may be introduced to the mixture distributing box or to the air-fuel mixer by a so-called forced draft or a so-called induced draft.

The method 400 may continue at block 420 where the air-fuel mixture is distributed so that it may be more evenly distributed across an upstream side of a flat burner. The mixing process may be aided by a deflector located within the mixture distributing box that may have the effect of deflecting or disturbing the flow of the air-fuel mixture. For example, the deflector may be placed in front of the outlet of the air-fuel mixing box, altering the flow of the air and fuel within the air-fuel mixing box and thereby causing the air-fuel mixture to be more evenly distributed across a cross-sectional area of the air-fuel mixture flow path.

The method 400 may continue at block 430 where the air-fuel mixture may be moved through a flat burner. The flat burner may comprise a thin and elongated body with an upstream side and a downstream side. The upstream side and downstream side of the flat burner may be permeable to allow the air-fuel mixture to pass through the flat burner. For example, the flat burner may comprise a great number of small perforations and/or a woven material over a substantial portion of the upstream and downstream sides of the flat burner. Further, the flat burner may be contained within a cavity comprising internal space of a mixture distribution box and internal space of a post-combustion chamber so that the air-fuel mixture leaving the air-fuel mixture distribution box passes through the upstream and downstream sides of the flat burner.

The method 400 may continue at block 440, where the air-fuel mixture may be ignited. The downstream side of the flat burner may face the post-combustion chamber. An igniter may be mounted in the post-combustion chamber near the downstream side of the flat burner. The igniter may comprise a pilot light, a piezoelectric spark, or a hot surface igniter. As the air-fuel mixture passes through the flat burner, the igniter may ignite and cause at least partial combustion of the air-fuel mixture to begin near the downstream side of the flat burner.

The method 400 may continue at block 450 by venting the at least partially combusted air-fuel mixture through a heat exchanger. Combustion may occur at least partially near the downstream side of the flat burner so that heat is generated and forced downstream of the flat burner and into the post-combustion chamber. In this embodiment, the combustion may occur generally at or near the downstream side of the flat burner. In alternative embodiments, combustion may occur both at the upstream and downstream sides of the flat burner as well as within an interior of the flat burner. The post-combustion chamber may be configured to divide the single flow path associated with the flat burner into multiple parallel flow paths. One or more of the multiple parallel flow paths may comprise a heat exchanger. The heat exchangers may be tubular in design with an upstream end connected to the post-combustion chamber and a downstream end connected to either a heat exchanger exhaust chamber or to a manifold. An upstream end of a downstream heat exchanger may be connected to the manifold and a downstream end of the downstream heat exchanger may be connected to a heat exchanger exhaust chamber. A heat exchanger exhaust chamber may be disposed downstream from the heat exchanger(s) and may be configured to recombine the plurality of flow paths within the heat exchanger(s) into a single flow space. The at least partially combusted air-fuel mixture may comprise $NO_X$. The level of $NO_X$ in the at least partially combusted air-fuel mixture may be lowered by varying the combustion temperature of the air-fuel mixture and/or the ratio of air to fuel within the mixture.

The method 400 may continue at block 460 by conditioning air outside of the heat exchanger. As the hot at least partially combusted air-fuel mixture travels through either the heat exchanger(s) toward the heat exchanger exhaust chamber, the heat exchanger(s) may be heated. Air that is exterior to the heat exchanger(s) may be moved into contact with the heat exchanger(s). As the air moves across the heat exchanger(s), heat may be transferred from the heat exchanger(s) to the air passing by the heat exchanger(s).

The method 400 may conclude at block 470 by venting the conditioned air into an air conditioned space, for example, an office space or living area of a home. The heated air may be used to warm the space in order to increase comfort levels for occupants and/or to maintain the contents of the space at a pre-determined temperature.

Figure 7:
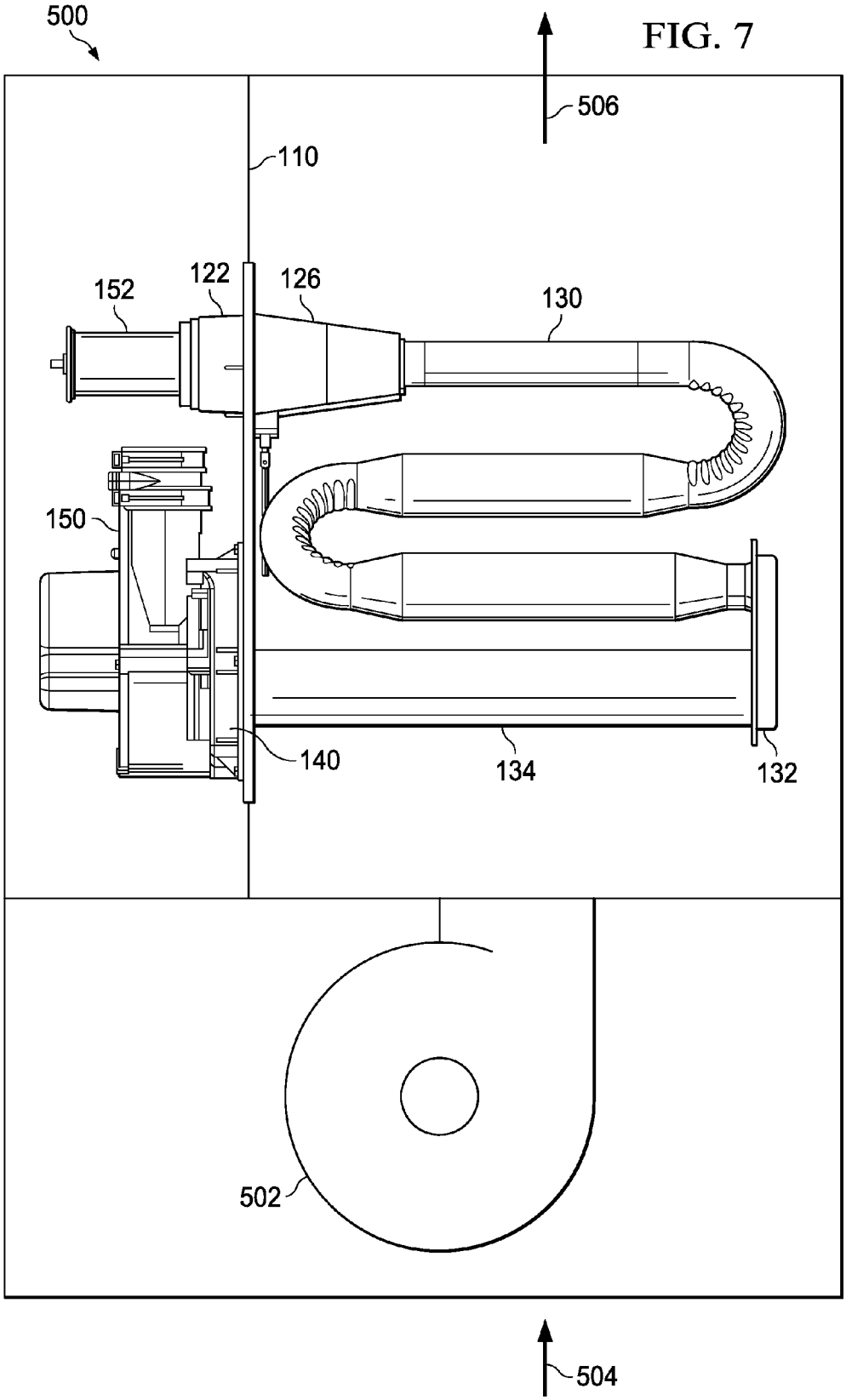
FIG. 7 is a schematic view of a furnace according to another embodiment of the disclosure.

Referring now to FIG. 7, a furnace 500 is shown. Furnace 500 comprises a circulation air blower 502 that receives incoming airflow 504 and passes incoming airflow 504 into contact with downstream heat exchanger 134 and upstream heat exchanger 130 to transfer heat from the heat exchangers 134, 130 to the air. Exiting airflow 506 may be distributed to an area that is to be conditioned with the heated air. A partition panel 110 may isolate the air-fuel mixture that may be at least partially combusted from the incoming and exiting airflows 504, 506. Due to a thin and elongate flat burner that may be disposed between the mixture distributing box 122 and post-combustion chamber 126, a size of the furnace 500 may be reduced relative to other furnaces that do not comprise a premix flat burner configured for use with an inducer draft.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and/or air conditioning (HVAC) furnace, comprising:

an air-fuel premixer configured to mix air and a fuel;

a mixture distributing box disposed downstream from the air-fuel premixer and comprising a deflector, wherein the deflector is disposed within the mixture distributing box such that the entirety of the air-fuel mixture mixed by the air-fuel premixer and combusted by the HVAC furnace passes through the mixture distributing box via a fluid flow path that is defined at least partially by a portion of the deflector and at least partially by an inner wall of the mixture distributing box;

a flat burner comprising an upstream side and a downstream side, the flat burner being configured to receive the entirety of the air-fuel mixture therethrough from the mixture distributing box via the fluid flow path, wherein the deflector of the mixture distributing box is configured to promote an even distribution of the air-fuel mixture over the upstream side of the flat burner;

a first flow path located adjacent the flat burner and downstream relative to the flat burner, the first flow path configured to receive fluid exiting the flat burner; and a plurality of second flow paths located downstream relative to the first flow path, the plurality of second flow paths being configured to receive fluid from the first flow path.

2. The furnace of claim 1, further comprising:

a third flow path located downstream relative to the plurality of second flow paths, the third flow path being configured to receive fluid from the plurality of second flow paths.

3. The furnace of claim 1, further comprising:

an inducer blower located downstream relative to the flat burner, the inducer being configured to selectively pull the air-fuel mixture through the flat burner.

4. The furnace of claim 1, wherein the flat burner comprises a woven material configured to be selectively permeated by the air-fuel mixture.

5. The furnace of claim 1, further comprising:

a first heat exchanger that substantially defines the bounds of at least one of the plurality of second flow paths.

6. The furnace of claim 5, further comprising:

a second heat exchanger disposed downstream relative to the first heat exchanger, the second heat exchanger being configured to receive the air-fuel mixture from a first number of flow paths and pass the received air-fuel mixture through a second number of flow paths of the second heat exchanger, wherein the second number of flow paths is greater than the first number of flow paths.

7. A method of operating a furnace, comprising:

providing a flat burner comprising an upstream side and a downstream side;

mixing air and fuel upstream of the flat burner in an air-fuel premixer;

distributing the air-fuel mixture by passing the air-fuel mixture through a mixture distributing box comprising a deflector, wherein the deflector is disposed within the mixture distributing box such that the entirety of the air-fuel mixture mixed by the air-fuel premixer and combusted by the flat burner passes through the mixture distributing box via a fluid flow path that is defined at least partially by a portion of the deflector and at least partially by an inner wall of the mixture distributing box, and wherein the deflector is configured to provide an even distribution of the air-fuel mixture to the upstream side of the flat burner; and pulling the entirety of the air-fuel mixture received via the fluid flow path through the flat burner.

8. The method of claim 7, further comprising:

at least partially combusting the air-fuel mixture near the downstream side of the flat burner.

9. The method of claim 8, wherein the at least partially combusting occurs in a first flow path and wherein the at least partially combusted air-fuel mixture is pulled into a plurality of second flow paths.

10. The method of claim 9, further comprising:

receiving the at least partially combusted air-fuel mixture from the plurality of second flow paths into a third flow path; and receiving the at least partially combusted air-fuel mixture from the third flow path into a plurality of fourth flow paths.

11. The method of claim 10, further comprising:

substantially bounding at least one of the plurality of second flow paths with a first heat exchanger; and substantially bounding at least one of the plurality of fourth flow paths with a second heat exchanger that is located downstream relative to the first heat exchanger.

12. A furnace, comprising:

an air-fuel premixer configured to mix air and a fuel;

a mixture distributing box disposed downstream from the air-fuel premixer and comprising a deflector, wherein the deflector is disposed within the mixture distributing box such that the entirety of the air-fuel mixture mixed by the air-fuel premixer and combusted by the furnace passes through the mixture distributing box via a fluid flow path that is defined at least partially by a portion of the deflector and at least partially by an inner wall of the mixture distributing box;

a post-combustion chamber coupled to the mixture distributing box, wherein the coupling of the mixture distributing box and the post-combustion chamber substantially envelope a cavity;

a flat burner disposed within the cavity and configured to receive the entirety of the air-fuel mixture from the mixture distributing box via the fluid flow path, wherein the deflector of the mixture distributing box is configured to promote an even distribution of the air-fuel mixture over an upstream side of the flat burner;

an upstream heat exchanger comprising a plurality of parallel heat exchanger flow paths configured to receive fluid from the cavity; and an inducer blower in fluid communication with the upstream heat exchanger, the inducer blower being configured to pull the entirety of the air-fuel mixture through the flat burner and the upstream heat exchanger.

13. The furnace of claim 12, further comprising:

a downstream heat exchanger located downstream relative to the upstream heat exchanger.

14. The furnace of claim 13, wherein the downstream heat exchanger comprises plurality of parallel heat exchanger flow paths and wherein the inducer blower is further configured to pull fluid through the downstream heat exchanger.

15. The furnace of claim 14, wherein a single flow path joins the upstream heat exchanger and the downstream heat exchanger in fluid communication so that fluid received from the upstream heat exchanger is recombined prior to being separated into the plurality of parallel heat exchanger flow paths of the downstream heat exchanger.

16. The furnace of claim 15, further comprising:

an exhaust chamber coupled to the downstream heat exchanger, the exhaust chamber being configured to receive fluid from the plurality of parallel heat exchanger flow paths of the downstream heat exchanger and combine them into a single flow path of the exhaust chamber.

17. The furnace of claim 12, further comprising a circulation air blower configured to move air into contact with the upstream heat exchanger.

18. The furnace of claim 12, further comprising:

a premixer located upstream relative to the mixture distributing box, the premixer being configured to mix air and a fuel.

* * * * *